US006837024B1

(12) United States Patent
Romagnoli

(10) Patent No.: US 6,837,024 B1
(45) Date of Patent: Jan. 4, 2005

(54) APPARATUS FOR AUTOMATICALLY AND CONTINUOUSLY FORMING ENVELOPES TO CONTAIN FILTER BAGS FOR INFUSION PRODUCTS

(75) Inventor: Andrea Romagnoli, San Lazzaro di Savena (IT)

(73) Assignee: Tecnomeccanica S.r.L., Bologna (IT)

( * ) Notice: Subject to any disclaimer, the term of this patent is extended or adjusted under 35 U.S.C. 154(b) by 0 days.

(21) Appl. No.: 10/624,197

(22) Filed: Jul. 22, 2003

(30) Foreign Application Priority Data

Jul. 23, 2002 (IT) ..... BO2002A0479

(51) Int. Cl.[7] ..... B65B 41/18
(52) U.S. Cl. ..... 53/170; 53/116; 53/548
(58) Field of Search ..... 53/449, 450, 455, 53/116, 170, 134.1, 134.2, 545, 548, 562; 414/776, 783; 426/410

(56) References Cited

U.S. PATENT DOCUMENTS 2,362,459 A * 11/1944 Barnett ..... 53/450
4,078,356 A 3/1978 Gallo et al.
4,261,680 A * 4/1981 Carnley et al. ..... 414/421
4,731,974 A * 3/1988 Billi ..... 53/170
4,853,071 A * 8/1989 Romagnoli ..... 53/134.2
5,749,453 A * 5/1998 Doornekamp et al. ..... 414/783
5,852,917 A * 12/1998 Romagnoli ..... 53/116
6,000,196 A * 12/1999 Boldrini et al. ..... 53/170
6,499,273 B1 * 12/2002 Marzocchi ..... 53/134.2
6,637,175 B2 * 10/2003 Ghirlandi ..... 53/134.2

OTHER PUBLICATIONS

European Search Report corresponding to Application No. EP 03 42 5472.

* cited by examiner

*Primary Examiner*—Louis Huynh
(74) *Attorney, Agent, or Firm*—Fay, Sharpe, Fagan, Minnich & McKee, LLP

(57) ABSTRACT

An apparatus (200) for automatically and continuously forming envelopes (51) to contain filter bags (1) for an infusion product comprises: means (60; 129, 131) for forming the envelopes, designed to make on a web (126) of packaging material moving along a predetermined feed path (174) a longitudinal fold line delimiting two adjacent flaps (127) defining an interposed opening through which the web (126) can be laterally accessed by the filter bags (1); manipulating means (123, 148, 128) designed to receive the filter bags (1) in succession, to turn them so that they lie in substantially the same plane as the web flaps (127) and to move the filter bags (1) along a feed path (62*a*, 62*b*, 62*c*) having at least one end stretch (62*c*) that is substantially centered relative to the web flaps (127), the filter bags (1) moving along the stretch (62*c*) in the same direction as the paper web (126) before the manipulating means (123, 148, 128) release the filter bags (1) between the web flaps (127).

21 Claims, 5 Drawing Sheets

APPARATUS FOR AUTOMATICALLY AND CONTINUOUSLY FORMING ENVELOPES TO CONTAIN FILTER BAGS FOR INFUSION PRODUCTS

BACKGROUND OF THE INVENTION

The present invention relates to the automatic production of filter bags, preferably of filter paper, containing products such as tea, chamomile and similar herbs designed to be immersed in a liquid in order to make infusions for various uses, for example, as beverages or for diverse medicinal purposes.

More specifically, the invention relates to an apparatus used in a continuous production process for automatically forming envelopes in which the filter bags containing the infusion product are accommodated, and which may if necessary, be sealed, for purposes of hygiene and in order to maintain the flavor and other characteristic properties of the infusion and/or to protect the filter bags themselves.

In the automatic production of filter bags for infusion products, the preparation of the envelopes and the insertion of the filter bags into them are performed, as is known, by special devices or units which: process webs of envelope paper; fold them onto themselves; associate them with filter bags received from a filter bag making machine; and seal the paper webs to form a continuous succession of chambers, each containing a filter bag, which are then separated from each other and sent to a further packaging unit.

In the process outlined above, the filter bags and the envelope paper web are fed along separate feed paths and the bags are associated with the web by intermittent, synchronized reciprocating movements at an area where their two paths intersect.

This type of process cycle requires filter bag making machines and devices or machine stations which wrap the filter bags in the envelopes which are extremely complex and whose maximum production speed is limited also by the type of feed paths followed by the bags and paper web and by the intermittent, reciprocating motion of the components.

The aim of the present invention is to overcome the above mentioned disadvantages by providing an apparatus in which the envelopes are formed and the filter bags associated with them according to continuous relative feed movements along feed paths which, in particular at the area where the filter bags are associated with the envelopes, are substantially parallel and run in the same direction.

SUMMARY OF THE INVENTION

In accordance with the invention, the above aim is achieved by an apparatus for automatically and continuously forming envelopes to contain filter bags for an infusion product, the apparatus comprising means for forming the envelopes, designed to make on a web of packaging material moving along a predetermined feed path a longitudinal fold line delimiting two adjacent flaps defining an interposed opening through which the web can be laterally accessed by the filter bags; manipulating means designed to receive the filter bags in succession, to turn them so that they lie in substantially the same plane as the web flaps and to move the filter bags along a feed path having at least one end section that is substantially centered relative to the web flaps, the filter bags moving along this end section in the same direction as the paper web, the manipulating means being designed to release the filter bags in such a way as to place them between the web flaps.

An apparatus according to the invention can operate at much higher production speeds than the maximum speeds permitted by prior art devices used for the same purpose. This feature, besides being advantageous in itself, is also such as not to have a negative retroactive effect on the filter bag making machine, which means that the apparatus can operate in line in conjunction with the filter bag making machine to create a fully automatic installation working at very high production speeds.

Thanks to the novel geometrical and kinematic arrangement of the feed paths of the filter bags and of the web of envelope material, and their continuous feed motion, the mechanical structure of the apparatus is much simpler, more reliable and economical than conventional apparatus used for the same purpose.

Further, this geometrical and kinematic arrangement makes it possible to construct machines extending principally in a single plane, that is to say, in a vertical plane, which means that the machines occupy a small amount of space, especially in the direction orthogonal to said plane.

BRIEF DESCRIPTION OF THE DRAWINGS

The technical characteristics of the invention, with reference to the above aims, are clearly described in the claims below and its advantages are apparent from the detailed description which follows, with reference to the accompanying drawings which illustrate a preferred embodiment of the invention provided merely by way of example without restricting the scope of the inventive concept, and in which:

DESCRIPTION OF THE PREFERRED EMBODIMENTS

Figure 1:
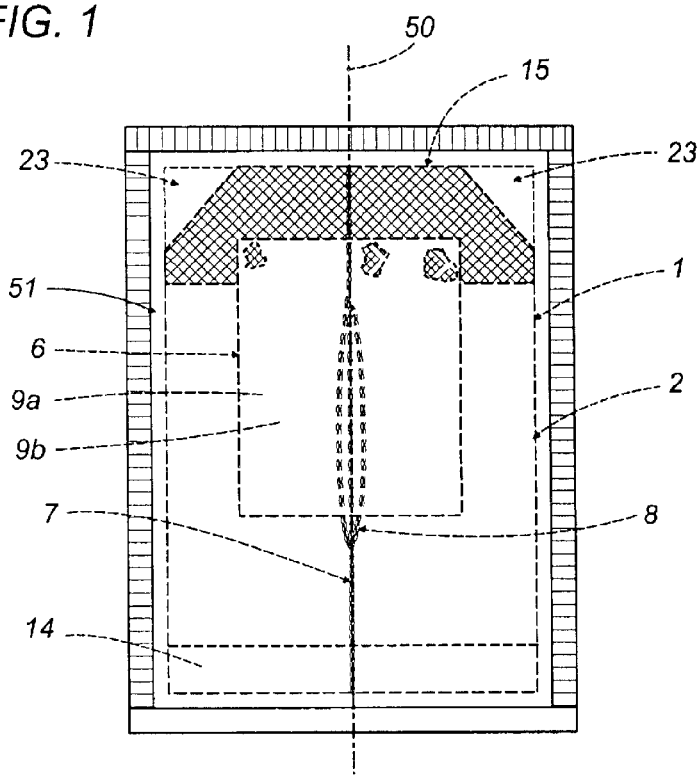
FIGS. 1 and 2 are, respectively, front and side elevation views of a filter bag containing an infusion product and wrapped in an envelope.
Figure 2:
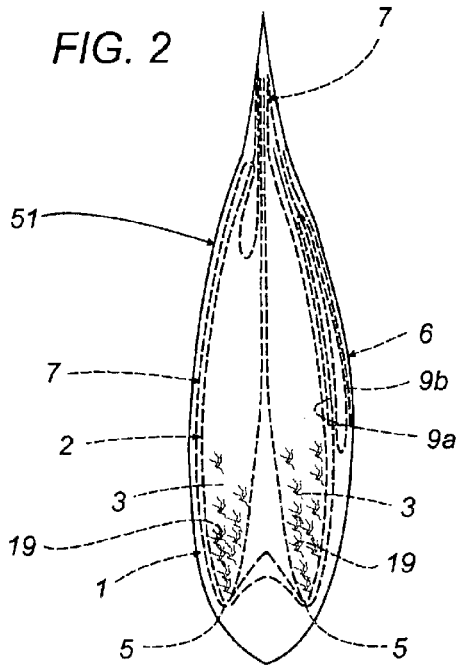

In FIGS. 1 and 2, the numeral 1 denotes in its entirety a filter bag containing an infusion product, such as tea, chamomile, or other herbal teas, having a containment chamber 2 consisting of two separate pouches 3, each containing a charge 19 of the infusion product. The filter bag 1 is contained inside an overwrapping or envelope 51, which encloses the filter bag 1 and protects its contents in terms, for example, of hygiene, flavor, aroma and other characteristic properties.

Figure 3:
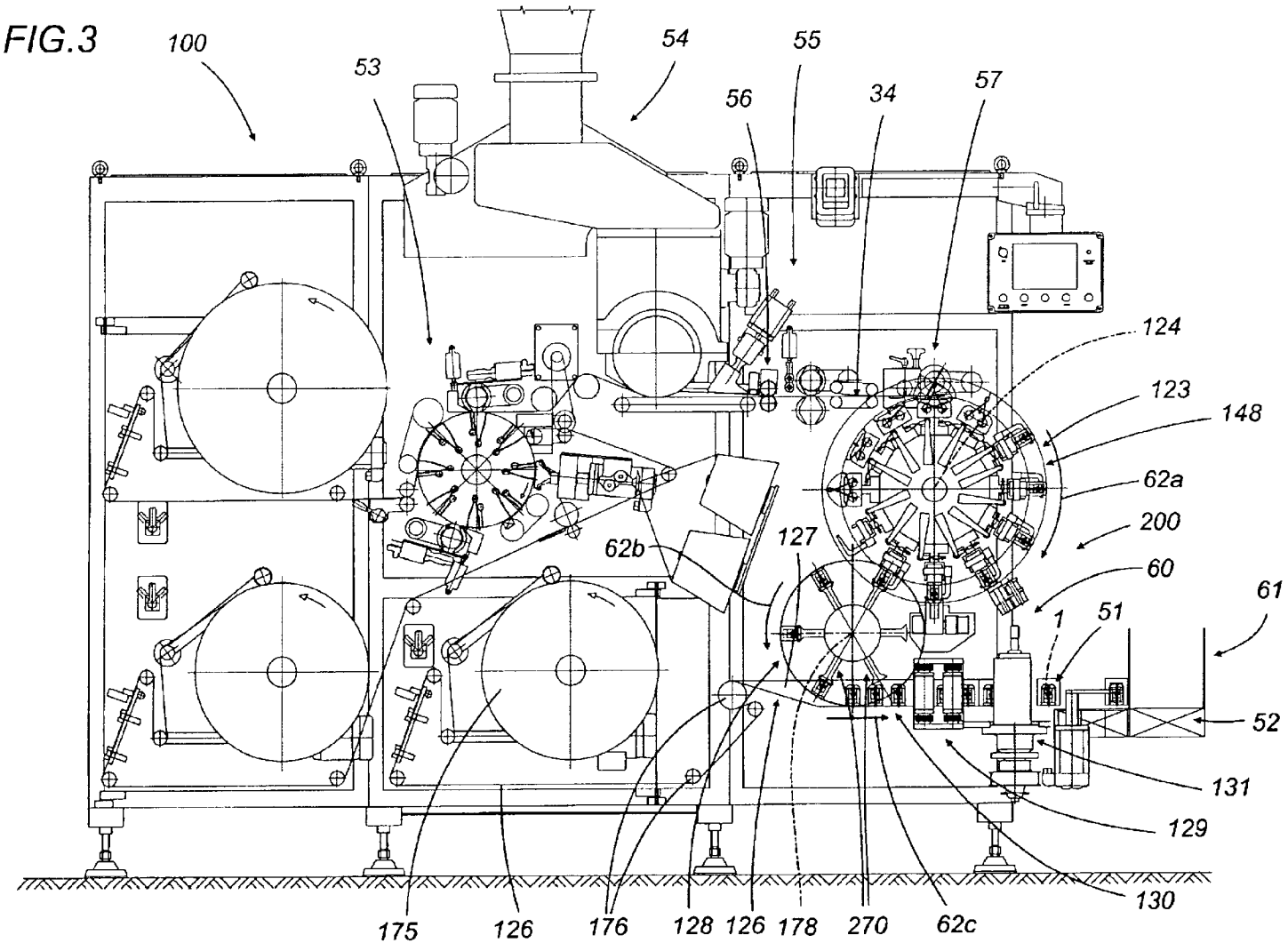
FIG. 3 is a schematic, front assembly view of a filter bag making machine, shown in elevation, incorporating an apparatus according to the invention.

The filter bag 1—which forms the subject matter of a prior patent application filed by the Applicant (IT BO2002A000013)—is made from heat-sealable paper; has a portion 7 of thread which is wound around the outside of the containment chamber 2 and which is longer than the outline of the chamber, the excess length 8 of the thread being gathered and held between faces 9*a*, 9*b* of a pick-up tag 6; and is made by a machine, labeled 100, illustrated in its entirety in FIG. 3.

The machine 100 essentially comprises a structure including the following, arranged in suitable operating sequence, in a line extending from left to right in FIG. 3 in which the production process is performed: a unit for preparing and feeding the materials used to make the filter bags 1, labeled 53 as a whole; an assembly for metering the infusion product, labeled 54 as a whole; a forming unit 55, a dividing unit 56 and a cutting unit 57.

Figure 4:
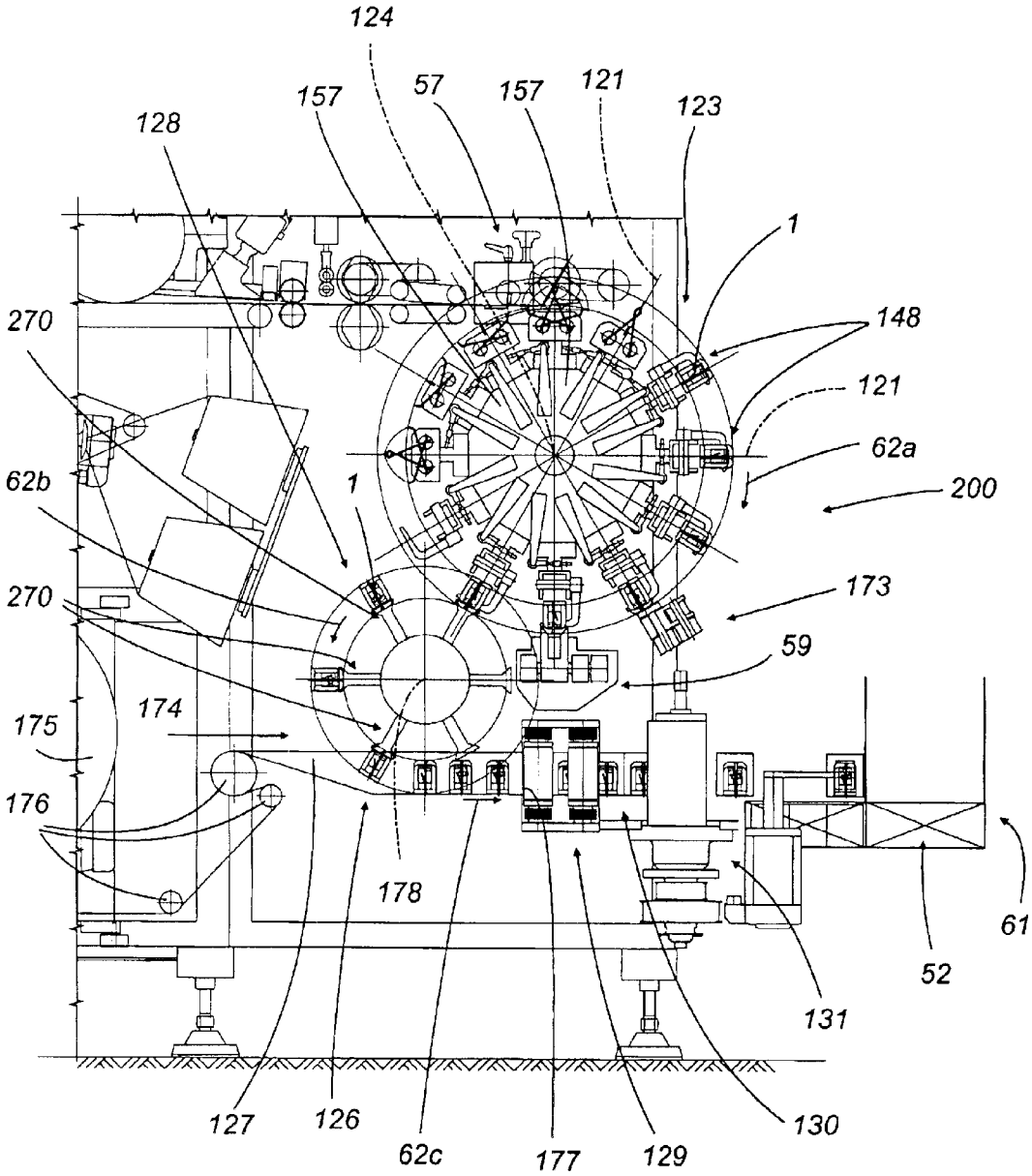
FIG. 4 is a partial front view illustrating an enlargement of a part of the apparatus of FIG. 3 in greater detail.

Downstream of the cutting unit 57 and at a lower level—as shown in more detail in FIG. 4—the machine 100 comprises an apparatus 200 which forms the specific subject-matter of the present invention and which in turn comprises the following, arranged in operating sequence: means, labeled 123, 148 e 128, for manipulating the filter bags 1; means, labeled 60, 129 and 131, for forming the envelopes; the apparatus 200 being followed, finally, by a cartoning unit, labeled 61 as a whole.

As described in more detail below, the envelope forming means 60 use a web 126 of packaging material—for example a heat-sealable paper—that is unwound from a roll 175 and fed along a straight, horizontal path 174. As it is unwound from the roll 175, the web 126 moves through a series of folding transfer rollers 176 that make a longitudinal fold line 177 along the middle of it which divides the web 126 into two flaps 127 placed side by side and defining an interposed opening. This opening is accessible from the top down, that is to say, from the side of the web 126 and transversely to the feed path 174.

Looking in more detail with reference to FIG. 4, the filter bag 1 manipulating means, which, in a vertical plane of the machine 100, are located between the cutting unit 57 above and the packaging material web 126 below, comprise a pair of wheels 123, 128 which revolve in opposite directions about respective horizontal axes 124 and 178 and which are associated with the cutting unit 57 and with the packaging material web 126, respectively.

The first wheel 123, the one with the larger diameter of the two, is equipped with a series of operating units 148 designed: to retain the filter bags 1; to turn the placement plane of each about an axis 121 radial to the first wheel 123 and passing through each operating unit 148; and to transport the filter bags 1 along a first, circular arc shaped section 62*a* of their feed path along which the filter bags 1 move in a clockwise direction, with reference to FIG. 4.

The second wheel 128 is equipped with grippers and is located tangentially to the feed path 174 followed by the web 126 of packaging material. The second wheel 128 is designed: to receive the filter bags 1 one after the other from the first wheel 123; to transport them along a second circular arc shaped section 62*b* of their feed path; to place them between the flaps 127 of the web 126; and, on reaching an end section 62*c* that is centered relative to the flaps 127 and where the feed path of the filter bags 1 is substantially tangent to the feed path 174 of the web 126 and where the filter bags 1 move in the same direction as the web 126, to release them onto the web 126 itself.

Figure 5:
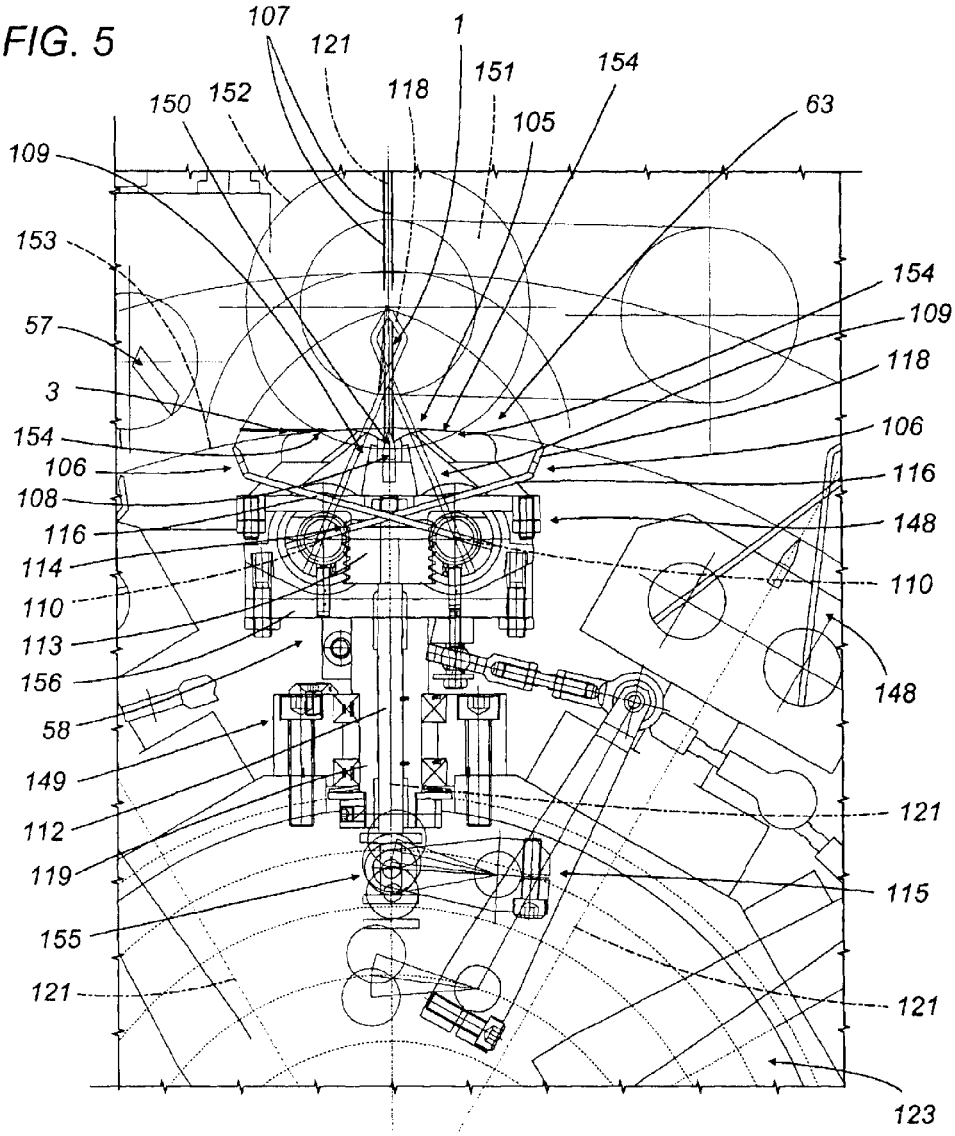
FIG. 5 is a partial front view of a detail from FIG. 4.
Figure 6:
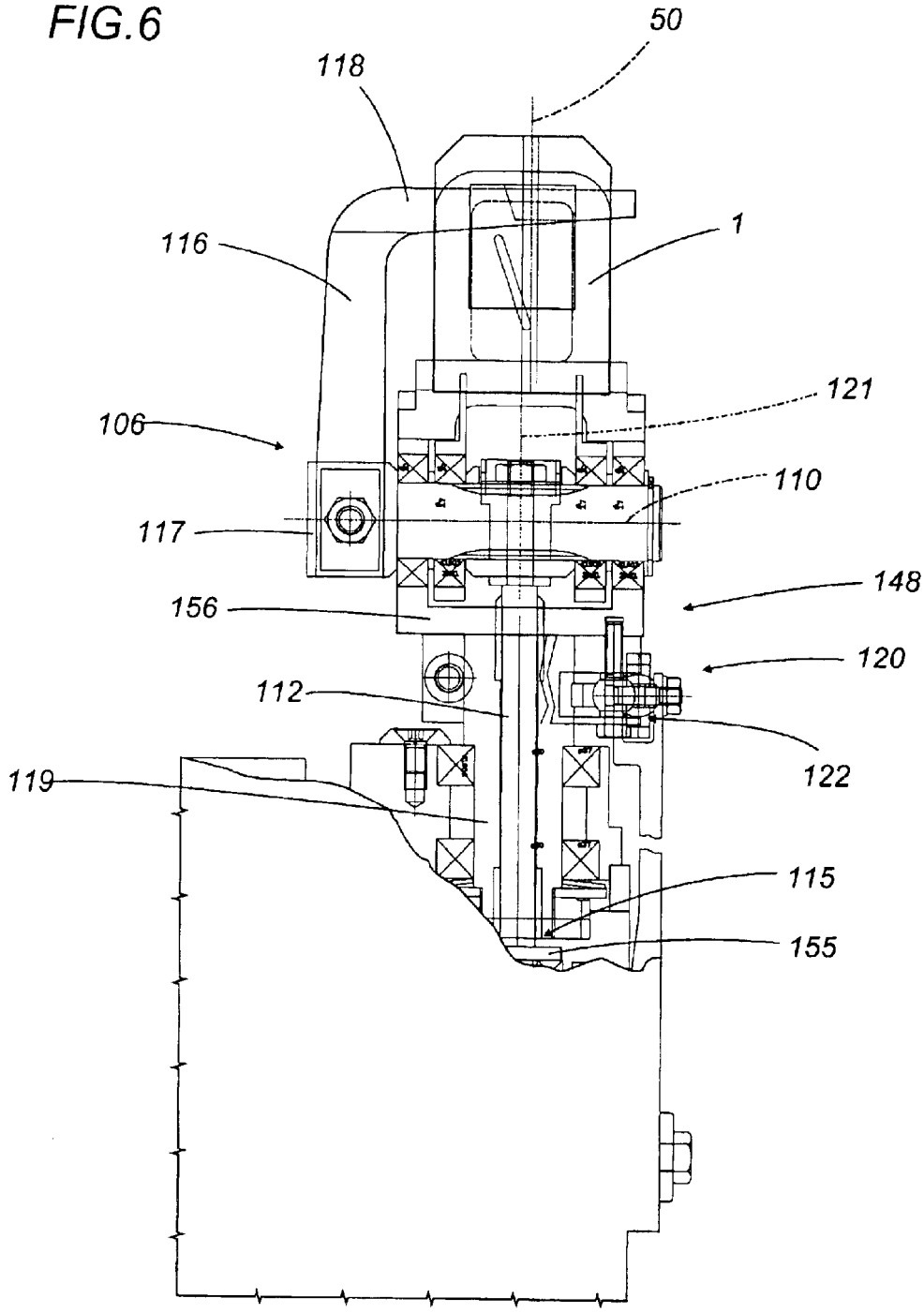
FIG. 6 is a side view of the detail of FIG. 5.

Looking in more detail at the operating units 148 of the first wheel 123, FIGS. 5 and 6 show that the operating units 148 essentially comprise a folding unit 63 and a turning unit 58.

Figure 5A:
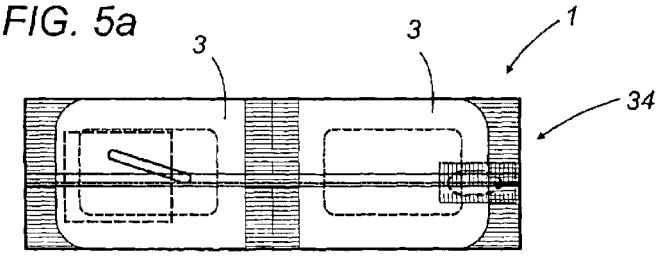
FIG. 5*a* is a plan view from above of a first detail from FIG. 5.

The units 63 and 48 are designed to operate on the filter bags 1 which the first wheel 123 receives from the cutting unit 57 in an initial condition such that the filter bags 1—as shown in the illustration in FIG. 5*a*—has the shape of a length of flattened tube 34. The flattened tube 34 lies in a horizontal plane parallel to the axis of rotation 124 of the first wheel 123 and in such a way that the two pouches 3 of its containment chamber 2 are positioned one after the other, in line with each other and above one of the operating units 148 which in the meantime is passing by immediately downstream of the cutting unit 57.

The folding units 63 and the turning units 58 are preferably combined in pairs to form a plurality of identical operating units 148, distributed at regular intervals around the edge of the first wheel 123.

As is more clearly discernible from FIGS. 5 and 6, each operating unit 148 associated with the first wheel 123 essentially comprises: a device, labeled 105 as a whole, for clamping the lengths of tube 34; a system of grippers 106, pivotably mounted around horizontal axes 110; and revolving heads 149 that unitarily mount the clamping device 105 and the system of grippers 106 and that are driven rotationally about axes of rotation 121 which are radial relative to the first wheel 123.

The device 105 for clamping the lengths of tube 34 comprises a pair of folding blades 107; a folding counterblade 108 and a pair of elastically opposing pressers 109 mounted on each side of the folding counterblade 108 in such a way that they can swing about the fixed axes 110 of the head 149 and designed to press against the sides of the counterblade 108 by elastic reaction.

Figure 5B:
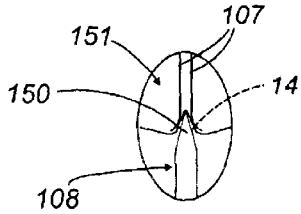
FIG. 5*b* is a scaled-up view of another detail from FIG. 5.

The folding blades 107—see FIG. 5*b* in particular—consist of two parallel thin flexible plates mounted on a revolving wheel 151 outside the first wheel 123. The folding counterblade 108 has a tapering end 150 and is mounted radially on the first wheel 123.

The first wheel 123 also mounts the pressers 109 which press, by elastic reaction, against the tapering end 150 of the counterblade 108.

The revolving wheel 151 mounting the folding blades 107 and the first wheel 123 are coupled in rolling relationship of relative primitive circles 152, 153, so that their phase-correlated rotation causes the folding blades 107 and the counterblade 108 to mesh with each other; this meshing occurring at the sealed join 5 between two contiguous pouches 3 of the interposed length of tube 34 constituting the filter bag 1. Thanks to this meshing, the sealed joins 5 of the lengths of tube fed in succession to the clamping device 105 are folded between the blades 107 and the counterblade 108 which confer the typical V shape at the bottom end 14 of the filter bag 1.

As can also be discerned from FIG. 5, the pressers 109, placed in elastically compliant contact against the sides of the counterblade 108, enable the folding blades 107 to move freely between them during the step of meshing with the counterblade 108. As the wheel 151 continues to rotate, the blades 107, having completed their folding action, are disengaged from the counterblade 108 and released from the lateral pressure exerted on them by the pressers 109, which now hold the filter bag 1 by the V-shaped fold.

The grippers 106—see also FIG. 6—include a pair of levers 116 which are rotatably coupled at one end to fixed pins 117, centered in the same axes of rotation 110 as the pressers 109 and which, at their opposite ends, have arms 118 designed to suitably interact with the lengths of tube 34 constituting the filter bags 1.

The levers 116 are mounted crosswise and each is therefore connected to the pin 117 of the presser 109 on the side opposite to that where it operates.

The levers 116 act in conjunction with the counterblade 108, with the pressers 109 and with suitably wide, fixed independent backs 154, in such manner as to support the lengths of tube 34 in the gripper 106 mounting wheel 123 in a substantially horizontal position and at three essentially aligned points.

When the levers 116 are tightened, the bottom of the tube length constituting the filter bag is held by the counterblade 108 and by the pressers 109 while the pouches 3 of the containment chamber 2 are folded onto each other in a vertical position so that they lie in planes parallel to the axis of rotation 124 of the first gripper 106 mounting wheel 123.

In other words, the filter bag 1, already held securely at the V-shaped fold at the bottom end 14, is also held by the top end 15 of the containment chamber 2 and kept in a position such that it lies in the same plane as a meridian plane of the gripper 106 mounting wheel 123, meaning by "meridian plane" a radial plane of the mounting wheel 123 containing the axis of rotation 124 of the wheel 123 itself.

The opening and closing movement of the gripper 106 levers 116 is accomplished by an actuating device comprising two articulated pinions 114 also rotatably mounted on the pins 117 of the pressers 109.

The pinions 114 are attached to the respective levers 116 and mesh with an interposed rack 113.

A rod 112 slidable in a radial guide in the gripper 106 mounting wheel 123 imparts rotational drive simultaneously on the levers 116 in phase with the angle of rotation traveled by the gripper 106 mounting wheel 123, the sliding motion of the rod 112 being imparted by an actuating element 115, consisting of a cam 155 that comes into contact with the end of the rod 112 furthest away from the levers 116.

As to the rotation of the filter bags 1 about their longitudinal axes 50, that is to say, about a radial axis 121 of the first gripper mounting wheel 123, FIG. 5 shows that the operating units 148 comprise a platform 156 fixed to a tubular upright 119 supported by the first gripper 106 mounting wheel 123.

The platform 156 supports the clamping device 105 and the grippers 106.

The upright 119, which houses the rod 112 that actuates the rack 113 and the pinions 114 acting on the pressers 109 of the clamping device 105 and on the levers 116 of the grippers 106, is mounted in such a way that it can rotate about a radial axis 121 of the gripper 106 mounting wheel 123.

The upright 119 is rotationally driven by actuator means 120 comprising linkages 122, equipped with ball joints, driven in coordinated phase with the angle of rotation described by the first gripper 106 mounting wheel 123.

The linkages 122 impart to the platform 156 a rotational movement about the radial axis 121, which passes through the related operating unit 148, in such a way that the filter bags 1 are turned through 900 relative to the positions they had prior to being turned. Following this rotation, the filter bags 1 lie in planes parallel to the parallel planes 157 of the gripper 106 mounting wheel 123, meaning by "parallel planes" the planes transversal to the axis of rotation 124 of the first wheel 123 (FIG. 4).

It should be noticed that the operating units 148 are advantageously structured to enable the filter bags 1 to be folded and turned as they move, while the first gripper 106 mounting wheel 123 rotates continuously.

The gripper 106 mounting wheel 123 is peripherally associated with a sealing unit 173 and a unit 59 for trimming the top ends 15 of the filter bags 1.

The sealing unit 173 seals together the pouches 3 of the containment chambers 2 of the filter bags 1. The trimming unit 59 cuts the corners of the filter bag 1 top ends 15, conferring on the top end 15 of each filter bag 1 its characteristic trapezoid shape.

It should be noticed that the sealing of the top ends 15 and the trimming of the corners 23 are performed on the portions of the filter bag 1 top ends 15 which—as shown in FIG. 6—protrude from the arms 118 of the levers 116 and project radially from the edge of the first wheel 123. These operations, since they are performed after the filter bags 1 have been turned so that they lie in planes parallel to a parallel plane of the first wheel 123, occur quickly and easily and do not require the gripper 106 mounting wheel 123 to be slowed down or stopped.

Between the first gripper 106 mounting wheel 123 and the envelope forming means, labeled 60 in their entirety, the apparatus 200 is equipped, as mentioned above, with a second gripper wheel 128 which is smaller in radius than the first wheel 123 and which rotates in the opposite direction.

The peripheral speed of the second gripper wheel 128 is identical to the peripheral speed of the first gripper wheel 123. Further, the grippers on it are synchronized with the grippers 106 on the first wheel 123 so that the filter bags 1 are transferred from the operating units 148 on the first wheel 123 to the grippers on the second wheel 128 which pick them up by their top ends 15 protruding from the arms 118 of the grippers 106 on the first wheel 123 (FIG. 4). Held in this way, the filter bags 1 move in a counterclockwise direction along the second section **62*b* of their feed path, and then, on reaching the end section 62*c* where their feed path is tangent to the feed path 174 of the web 126, the filter bags 1 are released by the grippers of the second wheel 128 between the flaps 127 of the envelope 51 paper web 126** at the desired minimum speed.

It should be noticed that the spacing of the filter bags 1 placed on the web 126 of envelope paper can be easily controlled by simply coordinating the feed speed of the web 126 of envelope paper with the peripheral speed of the second gripper wheel 128.

The envelope forming means 60 comprise not only a heat-sealable paper feed station 125 equipped with a roll 175, but also a heat-sealing station 129 and a cutting unit 131.

The heat-sealing station 129 seals the web 126 of envelope paper lengthwise along the open top flaps 127 and then seals the flaps 127 to each other crossways in such a way as to form a continuous flattened tube 130 divided into a succession of separate chambers, each accommodating a filter bag 1.

The cutting unit 131 then cuts the flattened tube 130 into lengths and sends the filter bags 1, each now wrapped in an envelope 51, to a cartoning unit 61 located downstream which places a collective packaging container 52 along the outfeed path of the filter bags, feeding it in such a way as to fill it according to predetermined filling patterns.

The invention described above optimizes the entire production cycle, thereby fully achieving the above mentioned aims. In the optimized production cycle embodied by the apparatus according to the invention, the filter bags 1 fed downstream of the cutting unit 57 are turned in such a way that each filter bag 1 lies in a plane parallel to the first wheel 123. After being turned in this way, the filter bags 1 keep this position to the end of the production cycle, which, besides the formation of the envelopes 51, also includes cartoning the filter bags 1 wrapped in the envelopes 51.

It will be understood that the invention described may be useful in many industrial applications and may be modified and adapted in several ways without thereby departing from the scope of the inventive concept.

Moreover, all the details of the invention may be substituted by technically equivalent elements.

What is claimed is:

1. An apparatus for automatically and continuously forming envelopes (51) to contain filter bags (1) for an infusion product, the apparatus comprising means (60; 129, 131) for forming the envelopes, designed to make on a web (126) of packaging material moving along a predetermined feed path (174) a longitudinal fold line delimiting two adjacent flaps (127) defining an interposed opening through which the web (126) can be laterally accessed by the filter bags (1); manipulating means (123, 148, 128) designed to receive the filter bags (1) in succession, in a first orientation, to turn the filter bags to a second orientation so that the filter bags lie in a plane substantially parallel to the web flaps (127) and to move the filter bags (1) along a feed path (62*a*, 62*b*, 62*c*) having at least one end section (62*c*) that is substantially centered relative to the web flaps (127), the filter bags (1) moving along this end section (62*c*) in the same direction as the web (126), the manipulating means being designed to release the filter bags (1) in such a way as to place the filter bags between the flaps (127) of the web (126).

2. The apparatus according to claim 1, wherein the means for manipulating the filter bags (1) comprise a first wheel (123) which rotates about a horizontal axis of rotation (124) and which is equipped with operating units (148) designed to retain the filter bags (1); to turn each of the filter bags about an axis (121) radial to the first wheel (123) and to transport the filter bags (1) along a first, arc shaped section (62*a*) of their feed path; the manipulating means also comprising a second gripper wheel (128) peripherally associated with the first wheel (123), rotating in the opposite direction and tangential to the feed path (174) of the web of packaging material, the second gripper wheel (128) being designed to receive the filter bags (1) one after the other from the first wheel (123), to transport the filter bags along a second arc shaped section (62*b*) of their feed path, to place the filter bags between the flaps (127) of the web (126) and to release the filter bags onto the web (126) itself.

3. The apparatus according to claim 2, comprising a unit (59), which is associated with the edge of the first wheel (123) and which is designed to trim the top end (15) of the filter bag (1) projecting radially from the edge of the first wheel (123).

4. The apparatus according to claim 3, wherein the second gripper wheel (128) is designed to grip the filter bags (1) by their top ends (15) projecting radially from the edge of the first wheel (123).

5. The apparatus according to claim 2, comprising a unit (173), which is associated with the edge of the first wheel (123) and which is designed to seal the top end (15) of the filter bag (1) projecting radially from the edge of the first wheel (123).

6. The machine according to claim 2, wherein the web (126) of packaging material has on it a layer of glue to be thermally activated, the means for forming the envelopes (51) including a heat-sealing station (129) where the web (126) of envelope material passing through with the filter bags (1) placed between the web flats (127) is sealed in such a way as to form a continuous flattened tube (130) divided into a succession of separate chambers, each accommodating a filter bag (1).

7. The machine according to claim 1, wherein the web (126) of packaging material has on it a layer of glue to be thermally activated, the means for forming the envelopes (51) including a heat-sealing station (129) where the web (126) of envelope material passing through with the filter bags (1) placed between its flaps (127) is sealed in such a way as to form a continuous flattened tube (130) divided into a succession of separate chambers, each accommodating a filter bag (1).

8. The machine according to claim 7, wherein the envelope forming means comprise a cutting unit (131) designed to cut the flattened tube (130) into successive lengths corresponding to the envelopes (51).

9. The apparatus according to claim 2, wherein the filter bags (1) have containment chambers (2) each consisting of two contiguous pouches (3) located one after the other, the operating units (148) of the first wheel (123) being equipped with a unit (63) for folding the pouches (3) of the filter bags (1) and with a unit (58) for turning the filter bags (1), these two units being combined with each other, the folding unit (63) being designed to fold the containment chamber (2) until the pouches (3) are mutually superposed, and the turning unit (58) being designed to turn the filter bags (1) about their longitudinal axes (50) so as to rotate the plane in which each filter bag (1) lies relative to the axis of rotation (124) of the first revolving wheel (123).

10. The apparatus according to claim 9, wherein the folding unit (63) comprises a device (105) for clamping the infusion product containment chamber (2) of the filter bag (1) and a system of grippers (106), pivotably mounted around horizontal axes (110), the clamping device (105) being designed to hold the containment chamber (2) by a bottom sealed joint (5) connecting its two contiguous pouches (3), the system of grippers (106) being designed to fold the containment chamber (2) pouches (3), initially lying flat, one after the other, onto each other until the pouches (3) are mutually superposed.

11. The apparatus according to claim 10, wherein the clamping device (105), while it holds the filter bag (1), also makes a fold in the bottom sealed join (5) which connects the pouches (3).

12. The apparatus according to claim 11, wherein the clamping and folding device (105) comprises a pair of folding blades (107) and a folding counterblade (108) on opposite sides of the filter bag (1) and pressing against each other in such a way as to make a fold in the bottom sealed joint (5) between two pouches (3); pressers (109) being provided, one on each side of the folding counterblade (108), which elastically oppose each other to allow the folding blades (107) to pass freely between the pressers and the counterblade (108) when the folding blades (107) and the counterblade (108) move towards each other, and, instead, to securely hold the bottom fold in the filter bag (1) by pressing the bottom fold against the counterblade (108) when the folding blades (107) move away from the counterblade (108).

13. The apparatus according to claim 12, wherein the folding blades (107) and the counterblade (108) are mounted on a revolving wheel (151) and on the first gripper wheel (123), which are coupled in rolling relationship of relative primitive circles (152, 153) in such a way that the folding blades (107) and the counterblade (108) mesh with each other.

14. The apparatus according to claim 12, wherein the pressers (109) are mounted in such a way that they can swing about respective horizontal axes (110).

15. The apparatus according to claim 10, wherein each gripper (106) includes a pair of levers (116) which are rotatably mounted on fixed pins (117), the levers (116) opening and closing in such a way as to make the pouches (3) of the filter bag (1) rotate about the bottom sealed joint (5) until they are mutually superposed.

16. The apparatus according to claim 15, wherein the levers (116) are mounted crosswise.

17. The apparatus according to claim 15, wherein the levers (116) have specially shaped ends (118) designed to interact with each other and to grip the filter bag (1) close to its top end (15) as soon as the pouches (3) of the filter bag (1) are folded onto each other.

18. The apparatus according to claim 9, wherein the folding unit (63) comprises a device (111) for actuating levers (116) equipped with a rack (113) mounted on a slidable rod (112) and rotatable pinions (114) which mesh with the rack (113) and which are attached to the levers (116), the sliding motion imparted on the rod (112) by an actuating element (115) in a first direction of rotation of the levers (116) causing the filter bag (1) to be folded in such a way as to superpose the pouches (3) of the containment chamber (2), and to be held by its top end (15), the sliding motion in the opposite direction placing the levers (116) in a condition in which the levers are ready to receive a filter bag (1) with the containment chamber (2) pouches (3) positioned in line.

19. The apparatus according to claim 18, wherein the actuating element (115) comprises a cam (155) associated with the slidable rod (112).

20. The apparatus according to claim 9, wherein the turning unit (58) comprises a head (149) that revolves about an axis (121) radial to the first gripper mounting wheel (123), means (120) for rotationally actuating the head (149) in synchrony with the rotation of the first wheel (123) causing the folding unit (58) to rotate in such a way as to turn the filter bag (1) so that the plane which the filter bag finally lies in is transversal to the axis of rotation (124) of the first wheel (123).

21. The apparatus according to claim 20, wherein the means (120) for rotationally actuating the head (149) comprise linkages (122) driven by mechanical cams in synchrony with the rotation of the first gripper wheel (123).

* * * * *